US010512925B2

(12) United States Patent
Nakano

(10) Patent No.: US 10,512,925 B2
(45) Date of Patent: Dec. 24, 2019

(54) TRIGGER SPRAYER

(71) Applicant: CANYON CORPORATION, Tokyo (JP)

(72) Inventor: Shinichiro Nakano, Sanyo Onoda (JP)

(73) Assignee: CANYON CORPORATION, Tokyo (JP)

( * ) Notice: Subject to any disclaimer, the term of this patent is extended or adjusted under 35 U.S.C. 154(b) by 0 days.

(21) Appl. No.: 16/095,453

(22) PCT Filed: Apr. 17, 2017

(86) PCT No.: PCT/JP2017/015423

§ 371 (c)(1),
(2) Date: Oct. 22, 2018

(87) PCT Pub. No.: WO2017/188035

PCT Pub. Date: Nov. 2, 2017

(65) Prior Publication Data

US 2019/0126305 A1 May 2, 2019

(30) Foreign Application Priority Data

Apr. 25, 2016 (JP) ..... 2016-087581

(51) Int. Cl.
*B05B 11/00* (2006.01)

(52) U.S. Cl.
CPC ..... *B05B 11/3011* (2013.01); *B05B 11/3045* (2013.01); *B05B 11/3016* (2013.01);
(Continued)

(58) Field of Classification Search
CPC . B05B 11/3011; B05B 11/00; B05B 11/3045; B05B 11/3016; B05B 11/3025; B05B 11/3069; B05B 11/3077
(Continued)

(56) References Cited

U.S. PATENT DOCUMENTS 4,527,741 A * 7/1985 Gameau ..... B05B 11/00 222/383.1
4,958,754 A * 9/1990 Dennis ..... B05B 11/0044 222/383.1

(Continued)

FOREIGN PATENT DOCUMENTS

JP 2001-179140 A 7/2001
JP 2014-028345 A 2/2014

(Continued)

*Primary Examiner* — Paul R Durand
*Assistant Examiner* — Michael J. Melaragno
(74) *Attorney, Agent, or Firm* — Muncy, Geissler, Olds & Lowe, P.C.

(57) ABSTRACT

To provide a trigger sprayer that can maintain uniformity of a chemical solution containing fine powder and is superior in flow efficiency. The trigger sprayer of the present invention is designed such that a piston part 5 is moved by a pivotal movement of a trigger part, while being attached to a container, so as to apply a pressure to a liquid inside a cylinder part 42A of a cylinder structural part 4 so that the liquid in the container is jetted from a nozzle part 3 through a passage P.

An F valve 2 attached to a bottom part of the cylinder part 42A serving a passage between the cylinder part 42A and the container and an S valve 1 installed in a passage part P between the cylinder part 42A and the nozzle part 3 are installed, and the F valve 2 is constituted by a cylinder-shaped base part 22 and a second valve body 21 having a sealing function as well as a small spring 22A coupling the cylinder-shaped base part 22 and the second valve body 21 to each other, and the second valve body 21 is further provided with a lower face part and a tilt part 21A on an opposite side, and the lower face part is fitted into the bottom part of the cylinder part 42A to be fixed therein, with the second valve body 21 being resiliently made in contact with a second valve mount 42A1 formed on the bottom part of the (Continued)

cylinder part 42A, and by pushing the tilt part 21A of the second valve body 21 by the bottom part of the piston part 5, the second valve body 21 is tilted so that one portion thereof is separated from the second valve mount 42A1, thereby opening the valve.

5 Claims, 12 Drawing Sheets

(52) U.S. Cl.
CPC ..... *B05B 11/3025* (2013.01); *B05B 11/3069* (2013.01); *B05B 11/3077* (2013.01)

(58) Field of Classification Search
USPC ..... 222/71, 383.1
See application file for complete search history.

(56) References Cited

U.S. PATENT DOCUMENTS 5,467,900 A * 11/1995 Maas ..... B05B 11/007 222/341
5,507,437 A * 4/1996 Foster ..... B05B 1/3431 239/333
5,513,800 A * 5/1996 Foster ..... B05B 1/3431 239/333
5,590,834 A * 1/1997 Foster ..... B05B 11/0005 239/333
5,622,317 A * 4/1997 Foster ..... B05B 11/0064 239/333
5,628,434 A * 5/1997 Foster ..... B05B 11/0064 222/383.1
5,645,221 A * 7/1997 Foster ..... B05B 11/0064 239/333
5,711,461 A * 1/1998 Foster ..... B05B 11/0064 222/383.1
5,716,008 A * 2/1998 Nottingham ..... B05B 11/303 239/333
5,806,724 A * 9/1998 Foster ..... B05B 11/001 222/383.1
5,884,820 A * 3/1999 Thanisch ..... B05B 11/007 222/383.1
6,234,412 B1 * 5/2001 von Schuckmann ..... B05B 1/3436 239/333
6,641,003 B1 * 11/2003 Foster ..... B05B 11/007 222/383.1
6,669,061 B2 * 12/2003 Tada ..... B05B 11/0032 222/153.13
6,886,718 B2 * 5/2005 Foster ..... B05B 11/3011 222/372
7,175,056 B2 * 2/2007 Buti ..... B05B 11/3011 222/340
7,455,198 B2 * 11/2008 Foster ..... B05B 11/3011 222/340
7,478,739 B2 * 1/2009 Foster ..... B05B 11/3011 222/383.1
7,497,358 B2 * 3/2009 Clynes ..... B05B 11/3011 222/340
7,637,396 B2 * 12/2009 Foster ..... B05B 11/3011 222/340
7,775,405 B2 * 8/2010 Sweeton ..... B05B 11/0064 137/540
8,684,235 B2 * 4/2014 Inaba ..... B05B 11/0029 222/153.13
8,714,415 B2 * 5/2014 Rech ..... B05B 11/0059 222/376
8,887,967 B2 * 11/2014 Alluigi ..... B05B 11/3011 222/383.1
9,808,819 B2 * 11/2017 Tada ..... B05B 11/3009
2006/0054642 A1 * 3/2006 Buti ..... B05B 11/3011 222/383.1
2006/0086763 A1 * 4/2006 Foster ..... B05B 11/3011 222/383.1
2007/0215647 A1 * 9/2007 Foster ..... B05B 11/3011 222/383.1
2007/0290005 A1 * 12/2007 Foster ..... B05B 11/3011 222/383.1
2007/0295757 A1 * 12/2007 Foster ..... B05B 11/3011 222/340
2011/0174843 A1 * 7/2011 Rech ..... B05B 11/0059 222/376
2013/0020355 A1 * 1/2013 Alluigi ..... B05B 11/3011 222/383.1
2013/0026192 A1 * 1/2013 Alluigi ..... B05B 11/3011 222/383.1
2013/0256339 A1 * 10/2013 Alluigi ..... B05B 11/3011 222/383.1
2014/0224842 A1 * 8/2014 Alluigi ..... B05B 11/3011 222/380
2014/0319244 A1 * 10/2014 Rech ..... B05B 11/0064 239/337
2015/0041490 A1 * 2/2015 Alluigi ..... B05B 11/3011 222/383.1
2015/0151316 A1 * 6/2015 Alluigi ..... B05B 11/3011 222/383.1
2015/0336123 A1 * 11/2015 Hoffmann ..... B05B 1/12 222/153.14
2015/0343472 A1 12/2015 Tada et al.
2018/0193860 A1 * 7/2018 Furutani ..... B05B 11/3009

FOREIGN PATENT DOCUMENTS

JP 2014-128779 A 7/2014
WO 2017/002334 A1 1/2017

* cited by examiner

TRIGGER SPRAYER

TECHNICAL FIELD

The present invention relates to a trigger sprayer, and more specifically concerns such a trigger sprayer that an F valve assembled in the trigger sprayer makes it possible to flow a filling liquid containing fine powder as smoothly as possible.

BACKGROUND ART

Conventionally, as a tool that is attached to a container so as to discharge or jet a liquid contained therein, a trigger sprayer has been widely used.

On principle, this trigger sprayer is provided with a piston and a cylinder, and by moving the piston, pressure is applied to the liquid inside the cylinder so that the liquid is jetted from a nozzle.

The trigger sprayer is classified into several types depending on how to move the piston. One of them includes a trigger sprayer of a type in which, for example, a trigger installed on the front side is pulled rearward by a finger.

When the trigger is grabbed by a hand and moved rearward, the piston is pressed downward in cooperation with the movement of the trigger so that the liquid pressure inside the nozzle is raised.

As a result, the liquid is energetically jetted from the nozzle part.

Moreover, another type thereof has been proposed in which a trigger is disposed on an upper portion of the main body, and by pushing the rear end of the tripper downward, the piston is pushed down in cooperation with the movement so that a pressure is applied to the liquid inside the cylinder (see Patent Literature 1).

The trigger sprayer of this type is provided with an F valve on the upstream side of a passage, and an S valve is installed on the downstream side thereof.

More specifically, the F valve is installed on the passage between a cylinder part and the container, and the S valve is installed on the passage between the cylinder part A and the nozzle part.

A liquid inside the container is once pulled up into the cylinder through the F valve, and the liquid thus pulled up into the cylinder is sent to a nozzle part through the S valve when a pressure is applied thereto, and jetted out.

By the way, as the liquid to be used in the trigger sprayer, soap liquid, milky lotion, etc. and chemical solution are normally used.

These liquids are mostly kept in a completely dissolved state without containing any foreign matter; however, some of them contain fine powder (see Patent Literature 1).

Such a chemical solution containing fine powder causes a problem in which in the container, the fine powder deposits onto the bottom part of the container.

In particular, in the case when the specific gravity of the fine powder is comparatively higher than that of the liquid, this tendency becomes more conspicuous.

When the trigger is activated with the deposition, as it is, being located on the bottom, the liquid having a high density of the fine powder is jetted out.

Of course, when the trigger is activated with no deposition being generated, the liquid having a low density of the fine powder is jetted out.

That is, since the same uniform liquid is not always jetted out, irregularity occurs in the liquid so that the liquid is preferably kept in a diffused state as much as possible.

On the other hand, in the case of a liquid having high density of fine powder, fine powder in a meshed state tends to occur between the valve body of the F valve and the valve mount.

Normally, a gap to be formed into a flow passage of the valve has a structure in which the gap is moved in a direction perpendicular to the flow to be opened; therefore, physically, no big gap cannot be obtained.

For this reason, the liquid containing fine powder causes high resistance when passing through the valve, that is, the gap between the valve body and the valve mount, so that high resistance is caused, resulting in a problem of passage efficiency.

In this manner, in a chemical solution containing fine powder, the conventional F valve has failed to solve the problems from the viewpoint of uniformity of the chemical solution to be jetted or the viewpoint of the passage efficiency of the liquid

CITATION LIST

Patent Literature

PTL 1: Japanese Patent Application Laid-Open No. 2001-179140

SUMMARY OF INVENTION

Technical Problem

The present invention has been devised in view of these prior-art problems, and its object is to provide a trigger sprayer which can maintain uniformity of a chemical solution containing fine powder and is superior in flow efficiency.

Solution to Problems

The present inventors have intensively studied so as to solve the above-mentioned problems, and have found that by installing a tilt part on a second valve body 21 of an F valve 2 and by also applying a pressure to push the tilt part by the bottom part of a piston part, a valve is opened so that the above-mentioned problems can be solved and the present invention is completed.

That is, the present invention relates to a trigger sprayer that is provided with a structure (1) in which a piston part 5 is moved by a pivotal movement of a trigger part, while being attached to a container, so as to apply a pressure to a liquid inside a cylinder part 42A of a cylinder structural part 4 so that the liquid in the container is jetted from a nozzle part 3 through a passage P, and this structure is further provided with an F valve 2 that is attached to a bottom part of the cylinder part 42A and forms a passage between the cylinder part 42A and the container and an S valve 1 installed in a passage part P between the cylinder part 42A and the nozzle part 3, and the F valve 2 is constituted by a cylinder-shaped base part 22, a second valve body 21 having a sealing function and a small spring 22A coupling the cylinder-shaped base part 22 and the second valve body 21 to each other, and the second valve body 21 is provided with a lower face part and a tilt part 21A on an opposite side to the lower face part, and the lower face part is fitted into the bottom part of the cylinder part 42A to be fixed therein, with the second valve body 21 being resiliently made in contact with a second valve mount 42A1 formed on the bottom part of the cylinder part 42A, and by pushing the tilt part 21A of the second valve body 21 by the bottom part of the piston part 5, the second valve body 21 is tilted so that one portion thereof is separated from the second valve mount 42A1, thereby opening the valve.

Moreover, the present invention, which relates to the trigger sprayer described in the above-mentioned structure (1), is further designed so that (2) by allowing the bottom part of the piston part 5 to come into contact with the tilt part 21A of the second valve body 21 to further proceed, the liquid located between the piston part 5 and the cylinder part 42A is returned to the inside of the container.

Furthermore, the present invention further relates to a trigger sprayer described in the above-mentioned structure (1) having a structure (3) in which a first valve body 11 of the S valve 1 has a passage hole 11C in a center axis direction so that the liquid flows through the passage hole 11C.

Furthermore, the present invention, which relates to the trigger sprayer described in the above-mentioned structure (3), is further designed so that (4) the first valve body 11 is constituted by a small diameter cylinder part 11A and a large diameter cylinder part 11B coupled to the outside thereof through a connection part, and onto the tip of the small diameter cylinder part 11A, a thin diameter expanding part J that gradually expands is formed, and two flange parts K are formed on the large diameter cylinder part 11B.

Moreover, the present invention, which relates to the trigger sprayer described in the above-mentioned structure (1), is further designed so that (5) a column hole 42B is formed on the cylinder structural part 4, and to the column hole 42B, an electing cylinder part 71 of an attaching base part 7 that can be attached to a container through a cap 9, is inserted and fixed therein, and the first valve mount 12 is formed on an upper end of the attaching base part 7.

Furthermore, the present invention, which relates to the trigger sprayer described in the above-mentioned structure (3), is further designed so that (6) to the upper end of the column hole 42B of the cylinder structural part 4, a suspending-type cylinder part 42C is formed so as to be suspended, and with the inner circumference of the suspending-type cylinder part 42C, the diameter expanding part J of the first valve body 11 of the S valve 1 is slidably made in contact, and with the inner circumferential face of the electing cylinder part 71 of the attaching base part 7, the flange part K of the first valve body 11 of the S valve 1 is slidably made in contact, and on the periphery of the suspending-type cylinder part 42C, a coil spring 13 for resiliently pressing the first valve body 11 downward is attached.

Additionally, any modified structure formed by combining the above-mentioned structures of the respective inventions on demand may be adopted as long as it meets the purpose of the present invention.

Advantageous Effects of Invention

In accordance with the trigger sprayer relating to the present invention, the following effects are provided.

The F valve is constituted by a cylinder-shaped base part, a second valve body having a sealing function and a small spring connecting the cylinder-shaped base part and the second valve body, and the second valve body is provided with a lower face part and a tilt part on an opposite side, and the lower face part is fitted into the bottom part of the cylinder part to be fixed therein, with the second valve body being resiliently made in contact with a second valve mount formed on the bottom part of the cylinder part, so that by pressing the tilt part of the second valve body with the bottom part of the piston part, the second valve body is tilted, and one portion thereof is separated from the second valve mount to open the valve; therefore, upon completion of a jetting process, the valve can be forcefully opened.

By the valve opening, the liquid located between the piston part and the cylinder part is returned into the container so that fine powder deposited on the bottom part of the container can be diffused as a whole.

Since the bottom part of the piston part is made in contact with the tilt part of the valve body and further proceeds, the liquid located between the piston part and the cylinder part is returned into the container; therefore, by the energetic movement of the liquid when returned into the container, fine powder deposited on the bottom part of the container can be diffused as a whole, with the result that the liquid is uniformed. Moreover, even if there is fine powder that has been already kept in a meshed state between the second valve body and the second valve mount, the fine powder can be removed by the energetic flow of the liquid.

Since the first valve body 11 of the S valve 1 is provided with a passage hole in a center axis direction, the liquid is allowed to flow through the passage hole so that lateral vibration of the first valve body 11 can be prevented as much as possible.

Thus, stable sliding movements can be carried out.

The first valve body 11 is constituted by a small diameter cylinder part 11A and a large diameter cylinder part 11B coupled to the outside thereof through a connection part, and onto the tip of the small diameter cylinder part 11A, a thin diameter expanding part that gradually expands is formed, and two flange parts are formed on the large diameter cylinder part 11B; therefore, the first valve body 11 is allowed to carry out stable sliding movements.

A column hole 42B is formed on the cylinder structural part 4, and to the column hole 42B, an electing cylinder part 71 of an attaching base part 7 that can be attached to a container through a cap 9, is inserted and fixed therein, and the first valve mount 12 is formed on an upper end of the attaching base part 7; therefore, the first valve mount 12 can be easily installed.

To the upper end of the column hole 42B of the cylinder structural part 4, a suspending-type cylinder part is formed so as to be suspended, and with the inner circumference of the suspending-type cylinder part, the diameter expanding part of the first valve body 11 of the S valve 1 is slidably made in contact, and with the inner circumferential face of the electing cylinder part 71 of the attaching base part 7, the flange part of the first valve body 11 of the S valve 1 is slidably made in contact, and on the periphery of the suspending-type cylinder part, a coil spring 13 for resiliently pressing the first valve body 11 downward is attached; therefore, the S valve 1 can be easily installed.

BRIEF DESCRIPTION OF DRAWINGS

FIG. 7 are views showing an F valve.

FIG. 10 are schematic views that explain a principle of a forceful valve-opening process.

FIG. 11 are schematic views that explain a principle of a normal valve-opening process.

DESCRIPTION OF EMBODIMENTS

Referring to drawings, the following explanation will be given to a trigger sprayer A in accordance with embodiments of the present invention.

Figure 1:
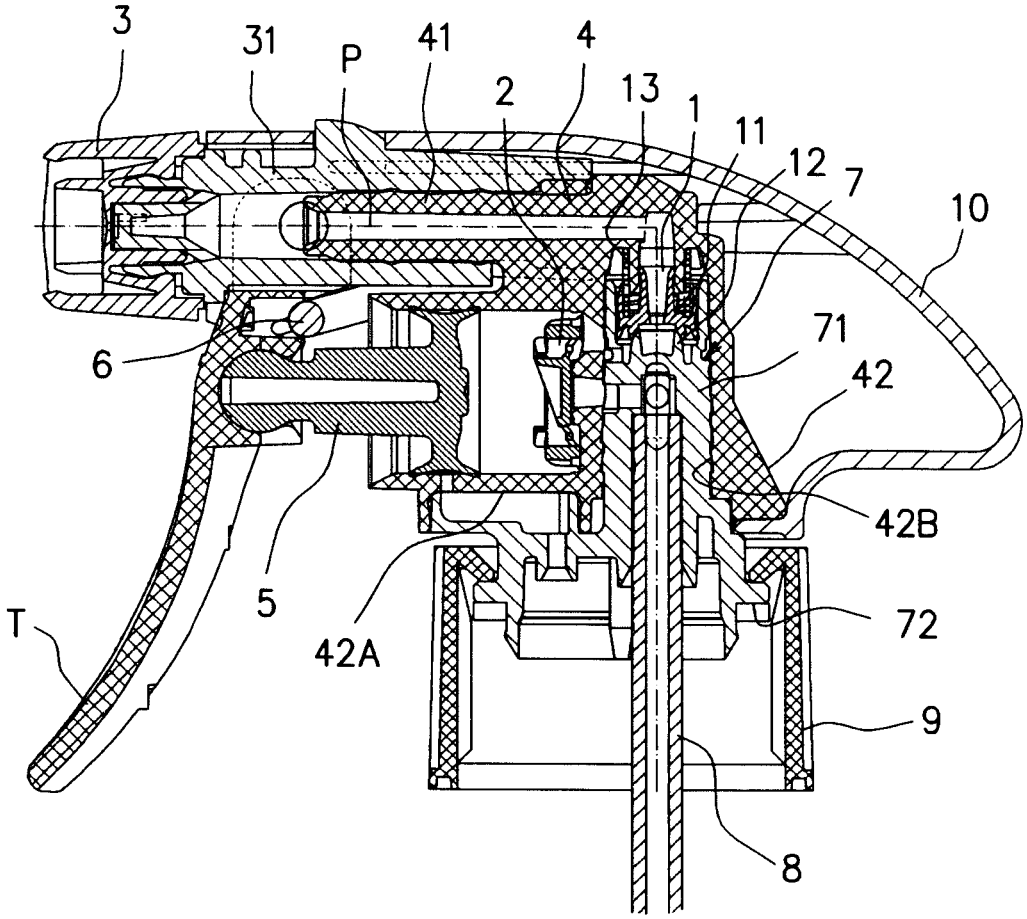
FIG. 1 is an entire longitudinal cross-sectional view showing a trigger sprayer in a valve-closed state in accordance with an embodiment of the present invention.
Figure 2:
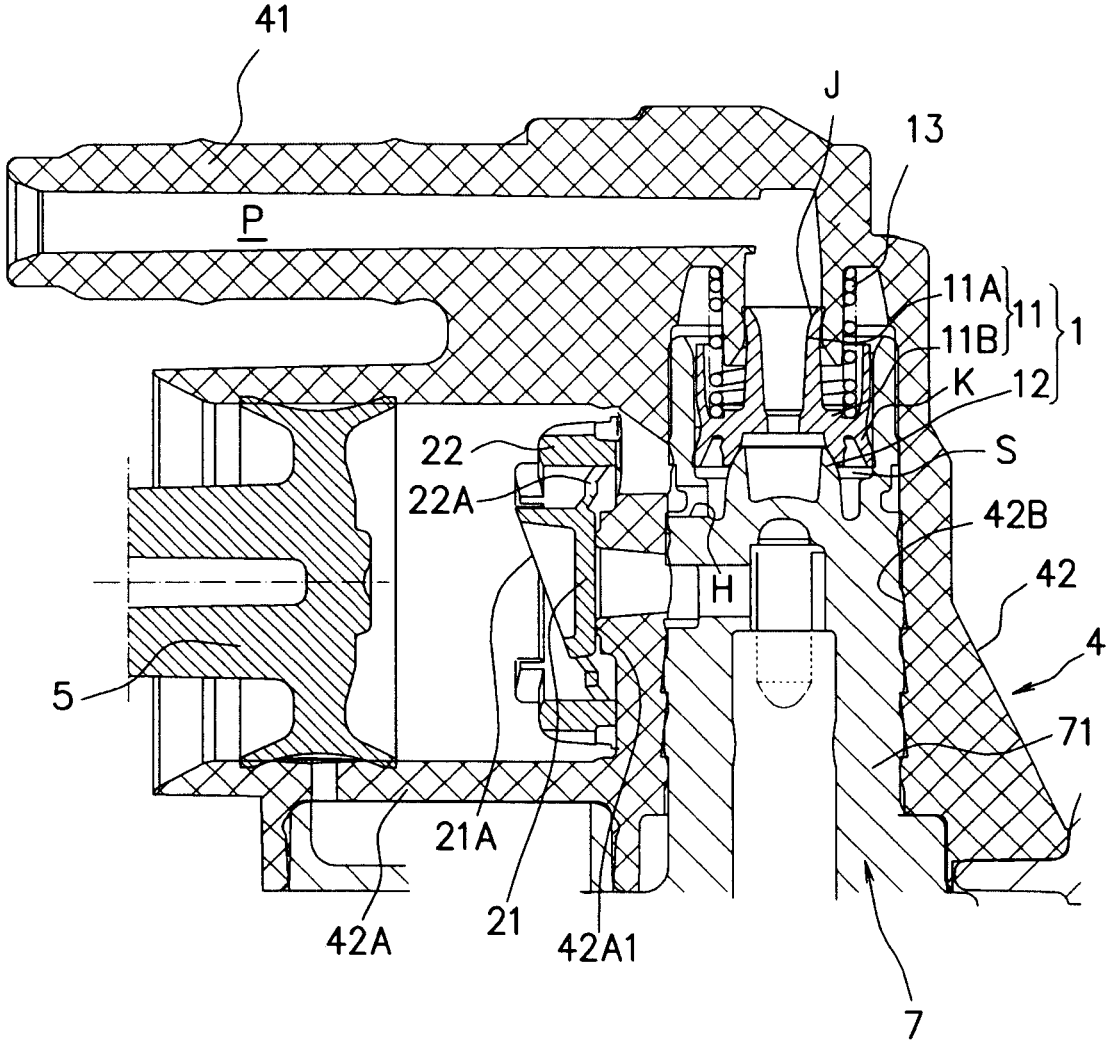
FIG. 2 is an enlarged longitudinal cross-sectional view showing the essential portion of the trigger sprayer in the valve-closed state in accordance with the embodiment of the present invention.

FIG. 1 is an entire longitudinal cross-sectional view showing a trigger sprayer in a valve closed-state (S valve) in accordance with the embodiment of the present invention; and FIG. 2 is an enlarged longitudinal cross-sectional view showing an essential part of the trigger sprayer in a valve closed-state (S valve) in accordance with the embodiment of the present invention.

Figure 3:
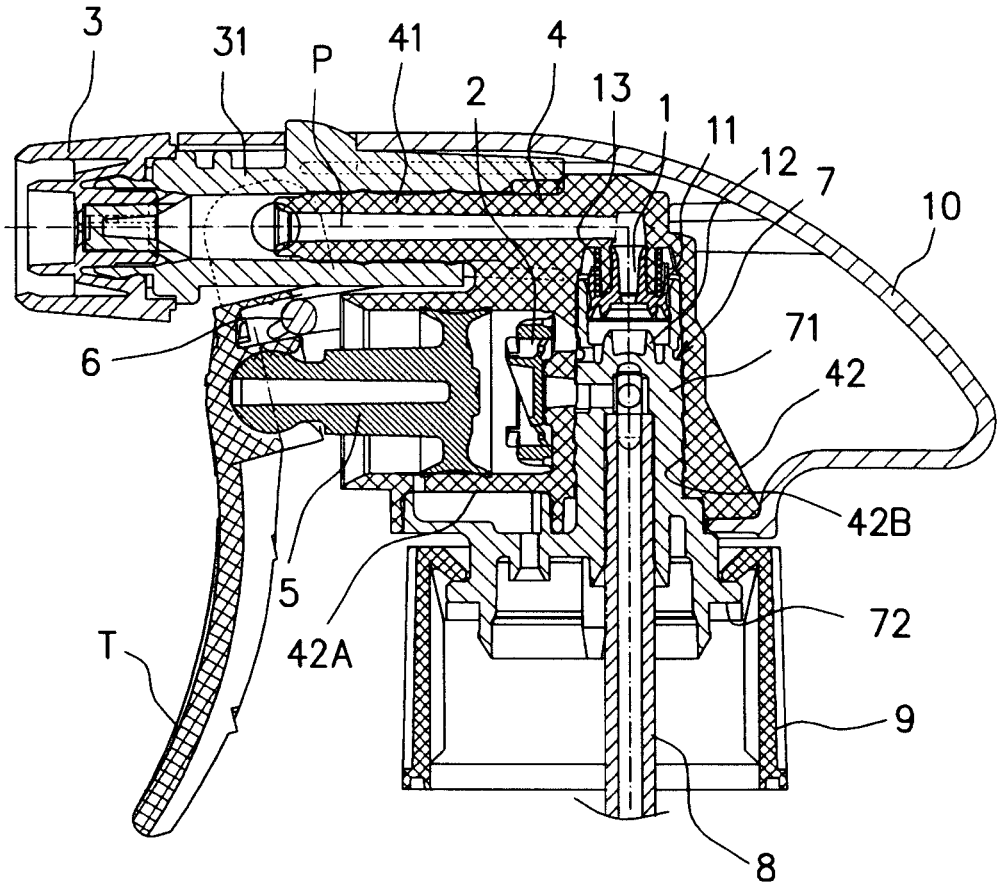
FIG. 3 is an entire longitudinal cross-sectional view showing the trigger sprayer in a valve-opened state in accordance with the embodiment of the present invention.
Figure 4:
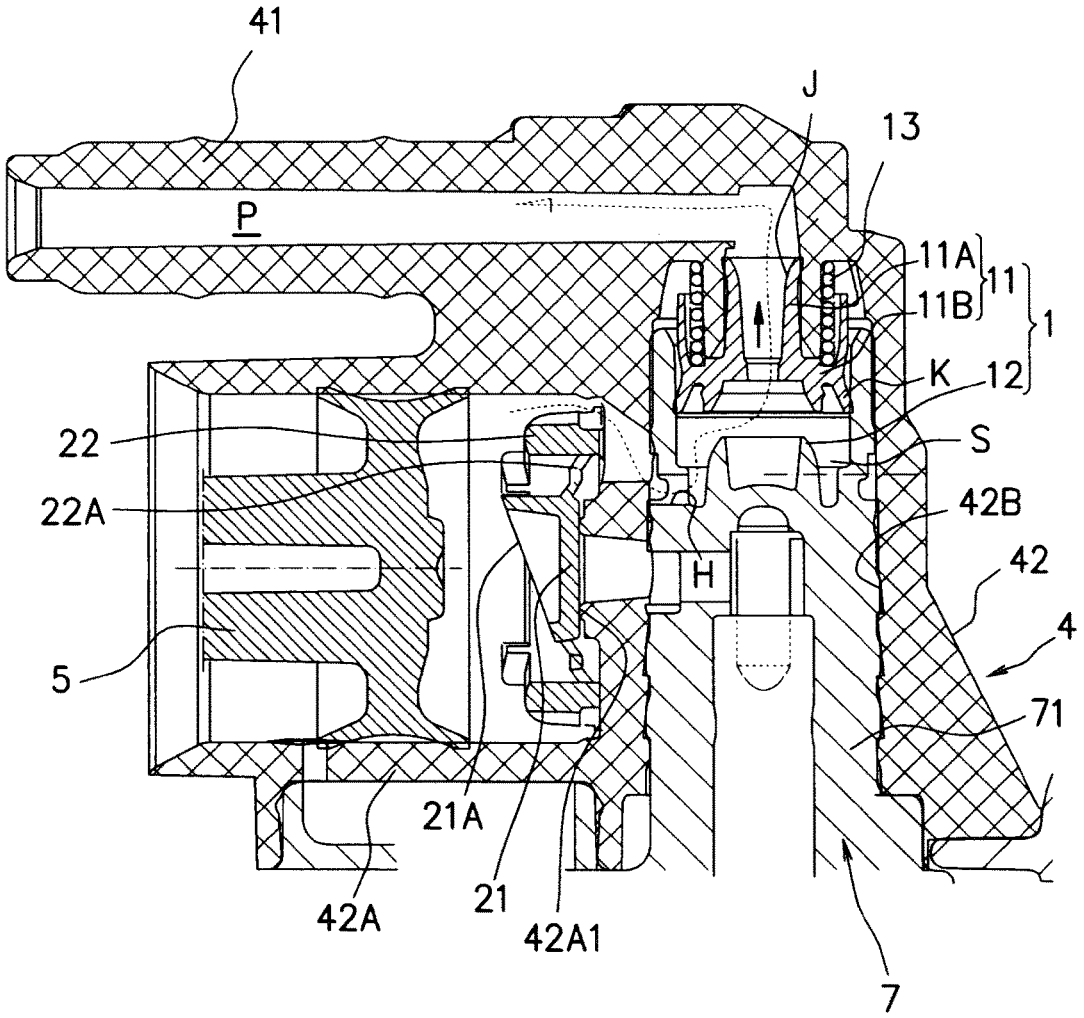
FIG. 4 is an enlarged longitudinal cross-sectional view showing the essential portion of the trigger sprayer in the valve-opened state in accordance with the embodiment of the present invention.

Moreover, FIG. 3 is an entire longitudinal cross-sectional view showing a trigger sprayer in a valve opened-state (S valve) in accordance with the embodiment of the present invention; and FIG. 4 is an enlarged longitudinal cross-sectional view showing an essential part of the trigger sprayer in the valve opened-state (S valve) in accordance with the embodiment of the present invention.

First, explanation will be given to the entire structure of a trigger sprayer.

The trigger sprayer of the present invention has a structure in which, when a piston part 5 is moved rightward by the pivotal movement of a trigger T, while being attached to a container, so that a pressure is applied to a liquid inside a cylinder part 42A of a cylinder structural part 4 (at this time, an F valve 2 is closed, while an S valve is opened), the liquid is jetted from a nozzle part 3.

Moreover, on the contrary, by moving the piston part 5 leftward by the returning pivotal movement of the trigger T, the inside of the cylinder part 42A of the cylinder structural part 4 is negatively pressurized so that the liquid inside the container is filled into the cylinder part (at this time, the F valve 2 is opened, while the S valve is closed).

In this case, the F valve 2 is installed in a passage between the cylinder part 42A and the container, and the S valve 1 is installed in a passage part between the cylinder part 42A and the nozzle 3.

Moreover, the trigger sprayer has a structure which is provided with the nozzle part 3, a nozzle base 31, the cylinder structural part 4, the piston part 5, the trigger T, a return spring 6, the S valve 1, the F valve 2, a coil spring 13, an attaching base part 7, a tube 8 and a cap 9.

Furthermore, a cover body 10 for covering the cylinder part 42A, the nozzle base 31 and the attaching base part 7 is installed.

In this case, the nozzle part 3 is attached to the tip of the nozzle base 31 by press-insertion, and the nozzle base 31 is also attached to the front side of the cylinder structural part 4 by press-insertion.

Moreover, onto the lower portion of the cylinder structural part 4, the attaching base part 7 is attached by press-insertion.

The trigger T is attached to the nozzle base 31 so as to freely pivot thereon, and is allowed to make a returning pivotal movement by a return spring 6.

Next, explanation will be given to respective parts that form the trigger sprayer.

Figure 5:
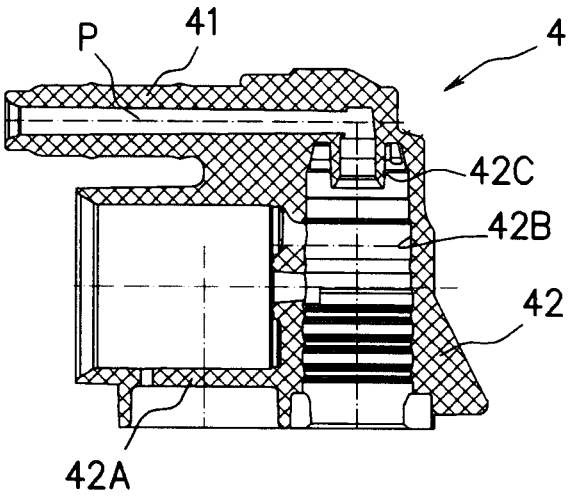
FIG. 5 is an enlarged longitudinal cross-sectional view showing a cylinder structural part.

FIG. 5 is an enlarged longitudinal cross-sectional view showing the cylinder structural part 4.

First, the cylinder structural part 4 is constituted by a base body part 42 and a horizontal part 41 having a passage P in a horizontal direction, and the base body part 42 is provided with a column hole 42B in the vertical direction and a cylinder part 42A.

To the horizontal part 41 of the cylinder structural part 4, a nozzle base 31 is attached by press-insertion, and to the tip of the nozzle base 31, a nozzle part 3 is attached by press-insertion.

Furthermore, to the column hole 42B, an attaching base part 7 to be described later is attached.

To the upper end of the column hole 42B, a suspending-type cylinder part 42C is formed so as to be suspended, and an S valve 1 to be described later in detail is attached to the suspending-type cylinder part 42C.

On the other hand, the attaching base part 7 is designed to be attached to a mouth portion of a container with a cap 9 interposed therebetween.

Figure 6:
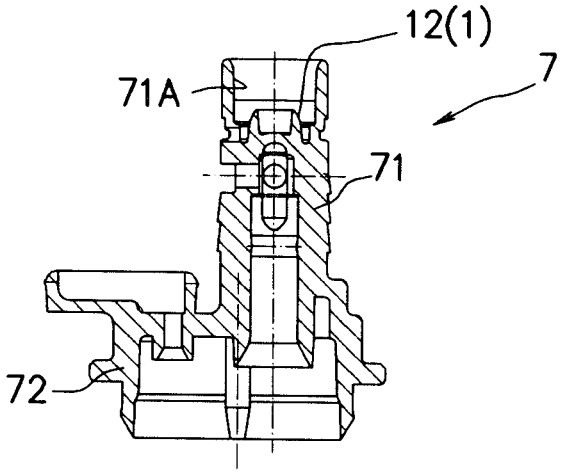
FIG. 6 is an enlarged longitudinal cross-sectional view showing an attaching base part.

FIG. 6 is an enlarged longitudinal cross-sectional view showing the attaching base part 7.

The attaching base part 7 is provided with a fixed part 72 to be attached to a container with the cap 9 interposed therebetween, and an electing cylinder part 71 that extends upward therefrom, and the electing cylinder part 71 is attached to the column hole 42B formed on the base body part 42 of the aforementioned cylinder structural part 4 by press-insertion.

In a state where the electing cylinder part 71 of the attaching base part 7 is attached to the column hole 42B of the base body part 42 of the cylinder structural part 4, a space S having a predetermined size is formed on the upper portion of the column hole 42B.

The S valve 1 is installed in the space S.

In this case, a portion that provides a function for the first valve mount 12 of the S valve 1 corresponds to the upper end of the electing cylinder part 71.

More specifically, onto the upper end of the electing cylinder part 71, an upper column hole 71A with a bottom is formed, and on the bottom portion of the upper column hole 71A, an annular protrusion 12 is formed so that the annular protrusion 12 provides a function for the first valve mount 12.

Additionally, the tube 8 serving as a passage to the container is inserted to the electing cylinder part 71 to be fixed therein.

The following description will discuss the F valve 2 that is provided with main characteristics of the present invention.

Figure 7A:
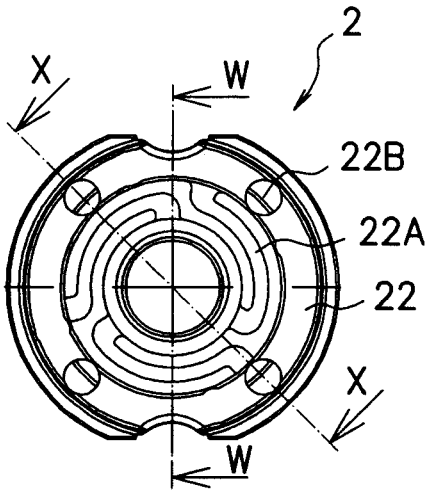
FIG. 7(A) is a plan view.
Figure 7B:
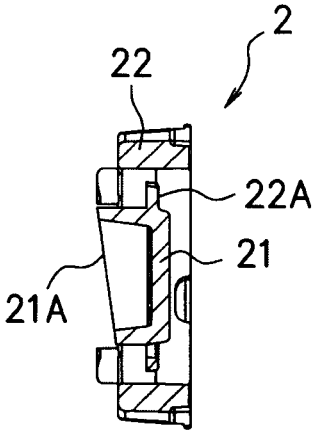
FIG. 7(B) is a longitudinal cross-sectional view taken along line W-W of FIG. 7(A)
Figure 7C:
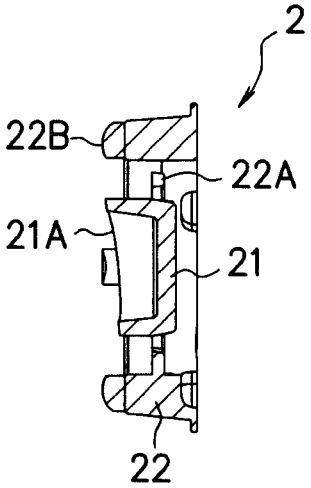
FIG. 7(C) is a longitudinal cross-sectional view taken along line X-X of FIG. 7(A).

FIG. 7 are drawings showing the F valve; FIG. 7(A) is a plan view; FIG. 7(B) is a longitudinal cross-sectional view taken along line W-W of FIG. 7(A); and FIG. 7(C) is a longitudinal cross-sectional view taken along line X-X of FIG. 7(A).

The F valve 2 is installed on a passage between the cylinder part 42A and the container, and is more specifically attached to the bottom portion of the cylinder part 42A.

The F valve 2 is designed to block from each other or join together the liquid on the container side and the liquid on the cylinder part side.

After a pressure has been applied to the cylinder part 42A and the liquid inside the pressurized cylinder part 42A has been jetted out, the F valve 2 is opened because the inside of the cylinder part is depressurized when the piston part 5 tries to return to its original position (normal valve opening).

The F valve 2 exerts valve functions by a second valve body 21 and a second valve mount 42A1, and an annular protrusion formed on the bottom part of the cylinder part 42A serves as the second valve mount 42A1.

Normally, the second valve body 21 is resiliently made in contact with the second valve mount 42A1, and is separated therefrom when the valve is opened.

As clearly shown by the drawings, the F valve 2 is constituted by a cylinder-shaped base part 22, the second valve body 21 having a sealing function and small springs 22A that couple the cylinder-shaped base part 22 and the second valve body 21 to each other.

Moreover, the F valve 2 is provided with a stopper 22B that protrudes from the cylinder-shaped base part 22.

In this case, the stopper 22B is formed as four column-shaped protrusions placed on the circumference with the same intervals.

Moreover, by fitting the cylinder-shaped base part 22 to the bottom part of the cylinder part 42A to be fixed therein, the F valve 2 is fixed onto the cylinder part 42A.

The second valve body 21 is provided with an upper surface portion on an opposite side to a lower surface portion, that is, a tilt part 21A, which is integrally coupled to the cylinder-shaped base part 22 by using the small springs 22A.

In this case, a plurality of the small springs 22A are installed between the second valve body 21 and the cylinder-shaped base part 22 in a well balanced manner so as to allow parallel movements upon application of a pressure from the upstream side.

That is, upon receipt of a pressure from the liquid sucked up from the container, the parallel movements are carried out toward the downstream side (left side in the drawing).

As for the functions of the F valve 2, the second valve body 21 is normally made in resiliently contact with the second valve mount 42A1 formed on the bottom portion of the cylinder part 42A so that the valve is kept in the closed state.

Then, by forcefully pushing the tilt part 21A of the second valve body 21 with the bottom portion of the piston part 5, the second valve body 21 is tilted so that one portion thereof is separated from the second valve mount so that the valve is opened (forceful valve opening).

In other words, after the trigger T has been pulled to move the piston part 5 and jet the liquid, the tilt part 21A is pushed by the bottom part of the piston part 5 to be tilted so that the gap between the second valve body 21 and the second valve mount 42A1 is opened.

In this case, the tilt of the second valve body 21 becomes greater as the piston part is further moved rightward so that the gap as the passage also becomes greater.

Next, more specifically speaking about the flow of a liquid, first the piston part 5 is made in contact with the tilt part 21A.

At this time, since no gap is generated between the second valve body 21 and the second valve mount 42A1, the liquid does not flow toward the container side yet.

Figure 8:
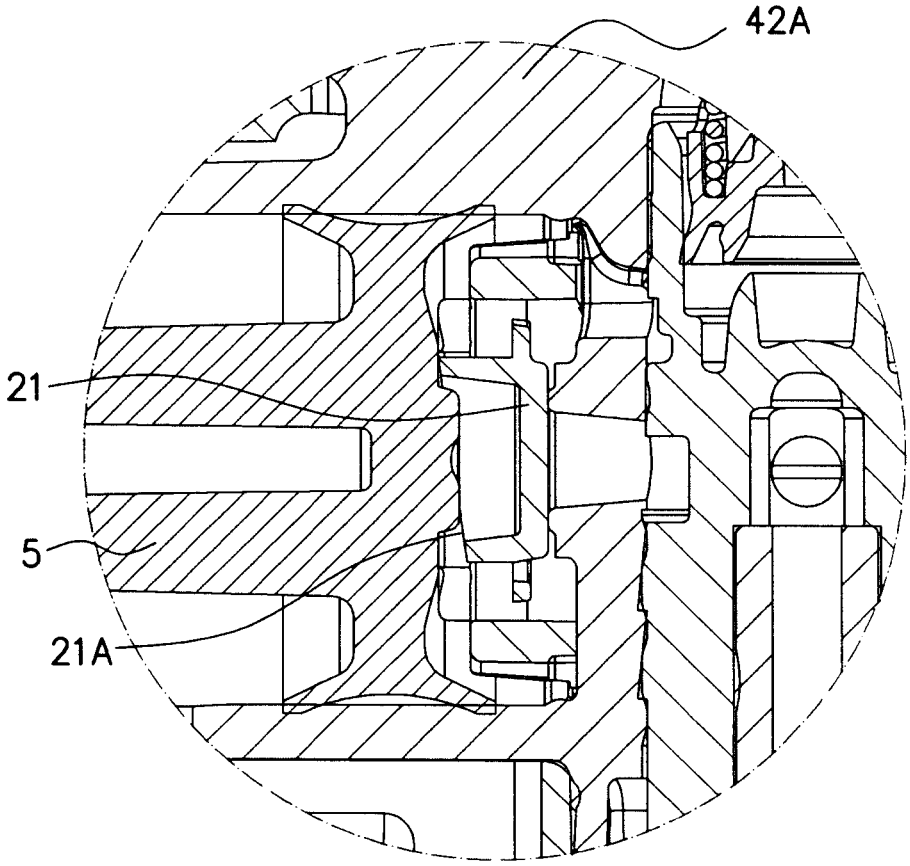
FIG. 8 is a view showing a state in which a piston part is just made in contact with a tilt part.

FIG. 8 is a drawing that shows a state in which the piston part 5 has just been made in contact with the tilt part 21A.

From this state, the piston part 5 is further moved rightward.

At this time, the gap is first generated between the second valve body 21 and the second valve mount 42A1 so that the valve is opened.

Moreover, since the liquid pressure inside the cylinder is lowered at the moment of opening the valve, the S valve is closed; however, simultaneously as this, the liquid inside the piston part escapes energetically toward the container side through the tube 8.

Then, fine powder deposited on the bottom part of the container is diffused by the energetic flow of the incoming liquid, with the result that the liquid is made uniform.

Additionally, even when there has already been fine powder in a meshed state between the second valve body and the second valve mount, the fine powder can be removed by the energetic flow of the liquid.

The piston part 5 is further moved rightward.

The gap becomes wider and wider, and more and more liquid flows toward the container side so that the diffusing function of the liquid inside the container is continued.

At the time when one portion of the bottom part of the piston part 5 comes into contact with a stopper 22B forming one portion of the F valve, the movement of the piston part 5 is stopped.

Additionally, at this time, the gap between the second valve body 21 and the second valve mount 42A1 becomes the largest.

Figure 9:
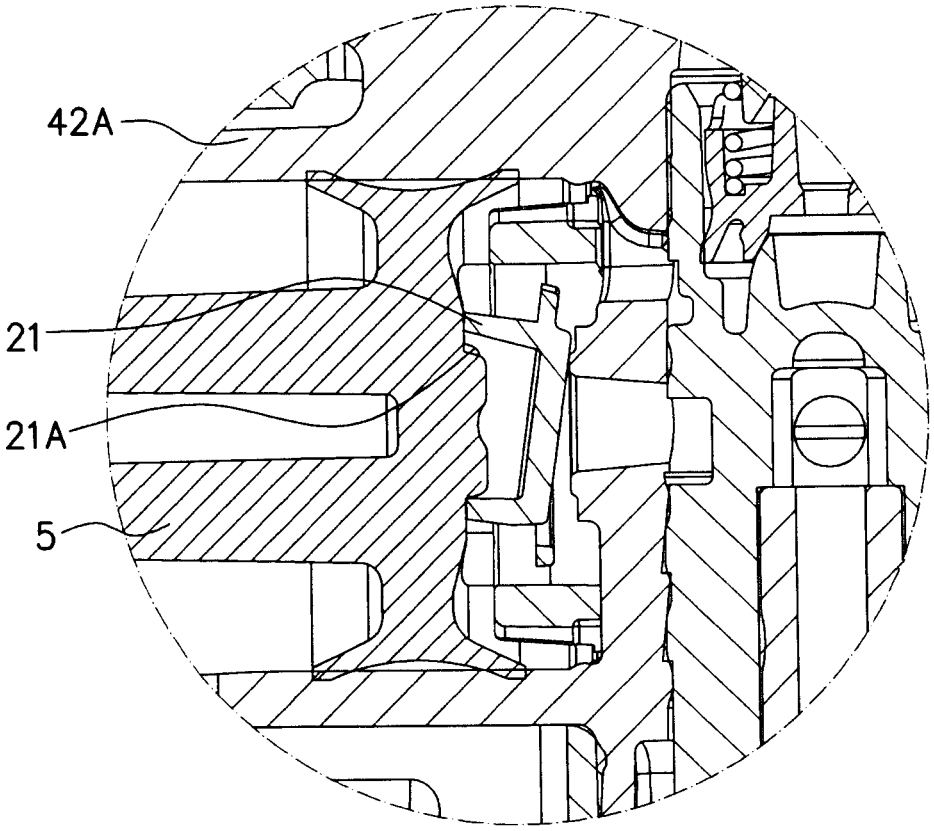
FIG. 9 is a view showing a state in which the piston part is just stopped.

FIG. 9 is a drawing showing a state where the piston part 5 has just been stopped.

When the trigger T is released at this time, the piston part 5 is moved so as to return to the downstream side (leftward) by a returning force of the return spring 6.

In accordance with this movement, the tilt of the second valve body 21 becomes gentler and the gap also becomes smaller accordingly.

Soon, there becomes no more contact between the piston part 5 and the second valve body 21, and the second valve body 21 is closed so that the gap no longer exists and the valve is closed.

However, since the piston part 5 is further moved leftward by the returning force, the inside of the cylinder is negatively pressurized, with the result that the second valve mount 42A1 is opened this time (normal valve-opening).

In this case, the second valve body 21 is not tilted, but moved in parallel.

More specifically, the second valve body 21 overcomes the spring force of the small springs 22A to move leftward in parallel, with the result that it is separated from the second valve mount 42A1 to cause the gap between the second valve body 21 and the second valve mount 42A 1.

Then, the liquid is sucked up from the container to the inside of the cylinder that is negatively pressurized.

The generated gap becomes larger although the contact area between the second valve body 21 and the second valve mount 42A1 is small so that fine powder in the meshed state is reduced.

When the piston is moved leftward to the maximum (in this case, the trigger T has been completely returned to the original position), the inside of the cylinder at this time is filled with the liquid sucked from the container.

At this time, the liquid with which the cylinder part is filled is a liquid that has been uniformly diffused inside the container.

Thereafter, the trigger T is pulled so that the uniform liquid can be jetted outside from the nozzle.

As explained above, it is understood that there are two types of valve-opening processes in the F valve, that is, "forceful valve-opening" and "normal valve-opening".

Figure 10A:
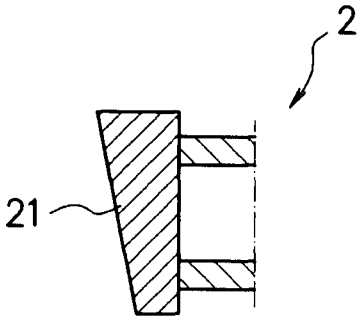
FIG. 10(A) shows a valve-closed state.
Figure 10B:
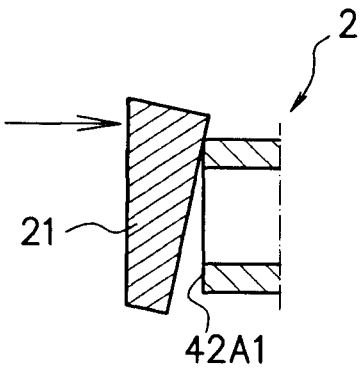
FIG. 10(B) shows a valve-opened state.

FIG. 10 are schematic views that explain a principle of a forceful valve-opening process; FIG. 10(A) shows a valve-closed state; and FIG. 10(B) shows a valve-opened state.

Figure 11A:
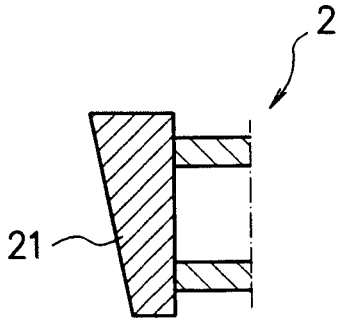
FIG. 11(A) shows a valve-closed state.
Figure 11B:
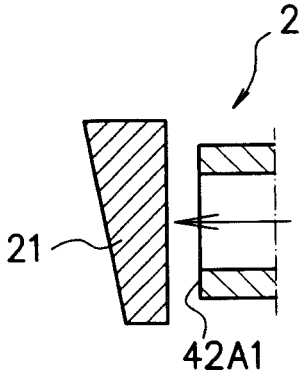
FIG. 11(B) shows a valve-opened state.

FIG. 11 are schematic views that explain a principle of a normal valve-opening process; FIG. 11(A) shows a valve-closed state; and FIG. 11(B) shows a valve-opened state.

"Forceful valve-opening" is a process in which the second valve body 21 is forcefully pushed by the bottom part of the piston part so as to be opened, and "normal valve-opening" is a process in which the inside of the cylinder is negatively pressurized, and the liquid inside the container is sucked up so that the valve is opened by the pressure at this time.

(Functions of S valve) The following description will discuss the S valve 1.

Figure 12:
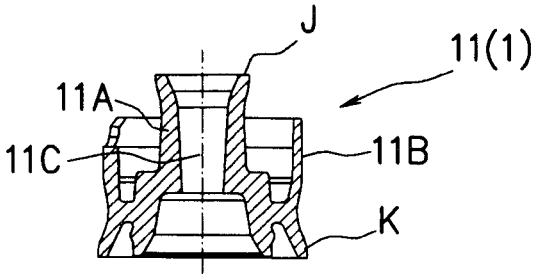
FIG. 12 is an enlarged longitudinal cross-sectional view showing a first valve body of an S valve.

FIG. 12 is an enlarged longitudinal cross-sectional view showing a first valve body 11 of the S valve 1.

The S valve 1 is constituted by the first valve body 11 and a first valve mount 12.

Additionally, in the first valve mount 12, one portion of the aforementioned base part 7 is used for its function.

The first valve body 11 is constituted by a small diameter cylinder part 11A and a large diameter cylinder part 11B coupled to the outside of the small diameter cylinder part 11A through a connection part.

Onto the tip of the small diameter cylinder part 11A, a thin diameter expanding part J that gradually expands is formed, and two flange parts K are formed on the large diameter cylinder part 11B.

Each of these diameter expanding part J and flange parts K exerts a resilient force outward.

Therefore, the small diameter cylinder part 11B is allowed to slidably move along the inner circumferential face of the suspending-type cylinder part 42C of the cylinder structural part 4 in a stable manner.

On the other hand, the large diameter cylinder part 11B is also allowed to slidably move along the inner circumferential face of the upper column hole 71A on the upper portion of the electing cylinder part 71 of the attaching base part 7 in a stable manner.

Moreover, a coil spring 13 is installed between the cylinder structural part 4 and the first valve body 11 of the S valve 1 so that the first valve body 11 is resiliently made in contact with the first valve mount 12.

Additionally, the coil spring 13 is attached to the periphery of the suspending-type cylinder part 42C of the cylinder structural part 4.

When, with the inside of the cylinder being filled with the liquid, the trigger T is pulled to apply a pressure by moving the piston part to the right side, (the S valve is opened, while the F valve is closed), the liquid is jetted from the nozzle.

At the time when hardly any liquid exists inside the cylinder part, upon releasing the trigger T, the piston is moved to the left side by its returning force to cause the inside of the cylinder to be negatively pressurized so that the liquid inside the container is filled into the cylinder [the S valve is closed, while the F valve is opened (normal valve-opening)].

The above-mentioned explanation has been given about preferable embodiments of the present invention; however, the present invention is not intended to be limited by the above-mentioned embodiments.

In the F valve 2, in an attempt for generating a gap serving as a flow passage between the second valve body 21 and the second valve mount 42A1 by tilting the second valve body 21, another method may be proposed in which the tilt part of the second valve body 21 is prepared as a flat face, while the bottom part of the opposing piston part is tilted, or still another method may be proposed in which a protrusion is formed on the bottom part of the piston part.

Moreover, with respect to the shapes of the cylinder structural part 4 and the attaching base part 7 for forming the trigger sprayer, designing modifications may be made within a scope of the purpose of the invention, and the same is true for the shapes of the nozzle base 31 and the nozzle part 3.

Furthermore, from the viewpoints of assembling operations, the number of parts may be changed by integrally forming two parts into one or by dividing one part into two, if necessary.

INDUSTRIAL APPLICABILITY

The trigger sprayer of the present invention is designed such that upon completion of a jetting process, the F valve can be forcefully opened by the movement of the piston part so that a remaining liquid between the piston part and the cylinder part can be returned into the container; therefore, by the energetic flow of the liquid, fine powder deposited on the bottom part of the container can be diffused as a whole so that the liquid is made uniform.

Therefore, the principle of this forceful valve-opening can be widely applied to the field of the trigger sprayer provided with the F valve.

REFERENCE SIGNS LIST

1 . . . S valve,
11 . . . first valve body.
11A . . . small diameter cylinder part,
11B . . . large diameter cylinder part,
11C . . . passage hole,
J . . . diameter expanding part,
K . . . flange part,
12 . . . first valve mount,
13 . . . coil spring.
2 . . . F valve.
21 . . . second valve body,
21A . . . tilt part,
22 . . . cylinder-shaped base part,
22A . . . small spring,
22B . . . stopper.
3 . . . nozzle part,
31 . . . nozzle base.
4 . . . cylinder structural part,
41 . . . horizontal part,
42 . . . base body part,
42A . . . cylinder part,
42A1 . . . second valve mount,
42B . . . column hole,
42C . . . suspending-type cylinder part,
5 . . . piston part,
6 . . . return spring,
7 . . . attaching base part,
71 . . . electing cylinder part,
71A . . . upper column hole,

72 . . . fixing part,
8 . . . tube,
9 . . . cap,
10 . . . cover body,
T . . . trigger,
P . . . passage,
H . . . through hole,
S . . . space

The invention claimed is:

1. A trigger sprayer, wherein a piston part is moved by a pivotal movement of a trigger part, while being attached to a container, so as to apply a pressure to a liquid inside a cylinder part of a cylinder structural part so that the liquid in the container is jetted from a nozzle part through a passage, comprising: an F valve attached to a bottom part of the cylinder part and an S valve installed in a passage part between the cylinder part and the nozzle part, wherein the F valve comprises a cylinder-shaped base part, a second valve body having a sealing function, and a small spring coupling the cylinder-shaped base part and the second valve body to each other, the second valve body is provided with a lower face part and a tilt part on an opposite side, and the lower face part is fitted into the bottom part of the cylinder part to be fixed therein, with the second valve body being resiliently made in contact with a second valve mount formed on the bottom part of the cylinder part, and wherein by pushing the tilt part of the second valve body by the bottom part of the piston, the second valve body is tilted so that one portion thereof is separated from the second valve mount, thereby opening the valve, the bottom part of the piston part is configured to be in contact with the tilt part of the second valve body and further moved so that a liquid located between the piston part and the cylinder part is returned into the container.

2. The trigger sprayer according to claim 1, wherein a first valve body of the S valve is provided with a passage hole in a center axis direction so that the liquid flows through the passage hole.

3. The trigger sprayer according to claim 2, wherein the first valve body comprises a small diameter cylinder part and a large diameter cylinder part coupled to an outside thereof through a connection part, and onto a tip of the small diameter cylinder part, a thin diameter expanding part that gradually expands is formed, and two flange parts are formed on the large diameter cylinder part.

4. The trigger sprayer according to claim 1, wherein a column hole is formed on the cylinder structural part and an electing cylinder part of an attaching base part that is attachable to the container through a cap is inserted into the column hole and fixed therein, and a first valve mount is formed on an upper end of the attaching base part.

5. The trigger sprayer according to claim 2, wherein a suspending-type cylinder part is formed onto an upper end of the column hole of the cylinder structural part so as to be suspended, and with the inner circumference of the suspending-type cylinder part, a diameter expanding part of the first valve body of the S valve is slidably made in contact, and onto an inner circumferential face of an electing cylinder part of an attaching base part, a coil spring for resiliently pressing the first valve body downward is attached.

* * * * *